US012253293B1

(12) United States Patent
White

(10) Patent No.: US 12,253,293 B1
(45) Date of Patent: Mar. 18, 2025

(54) ICE DISPENSER

(71) Applicant: Nicholas White, Aurora, IL (US)

(72) Inventor: Nicholas White, Aurora, IL (US)

( * ) Notice: Subject to any disclaimer, the term of this patent is extended or adjusted under 35 U.S.C. 154(b) by 0 days.

(21) Appl. No.: 18/664,189

(22) Filed: May 14, 2024

(51) Int. Cl.
*B67D 1/16* (2006.01)
*F25C 5/20* (2018.01)

(52) U.S. Cl.
CPC ..... *F25C 5/24* (2018.01); *F25C 2500/08* (2013.01)

(58) Field of Classification Search
CPC ..... F25C 5/24; F25C 2500/08
See application file for complete search history.

(56) References Cited

U.S. PATENT DOCUMENTS 2,237,189 A * 4/1941 Mccormack ..... A23G 9/287 222/245
2,857,083 A * 10/1958 Masterson ..... B65D 83/06 222/362
2,983,408 A * 5/1961 Schwartz ..... G01F 11/18 222/336
4,130,149 A * 12/1978 Hausam ..... A47G 19/34 141/358
4,531,658 A * 7/1985 Galopin ..... G01F 11/18 222/361
5,758,803 A * 6/1998 Liao ..... G01F 11/38 222/440
6,758,047 B1 7/2004 Giles
7,472,810 B2 * 1/2009 Amir ..... G01F 11/18 222/428
7,703,639 B2 4/2010 Landau et al.
7,874,457 B2 1/2011 Sowers et al.
2006/0191958 A1 8/2006 Brundick
2008/0256973 A1 * 10/2008 Miller ..... F25C 5/20 220/592.2
2011/0147420 A1 6/2011 Wong
2013/0214010 A1 8/2013 McCoy

* cited by examiner

*Primary Examiner* — Bob Zadeh
(74) *Attorney, Agent, or Firm* — Faegre Drinker Biddle & Reath LLP

(57) ABSTRACT

An improved ice dispenser having a serving chamber that feeds ice to dispensing tray which has a dispensing opening on a lower surface of the dispensing tray to feed ice to the end user. The dispensing tray is configured to slide from a closed position that keeps ice within the dispensing tube, to a fill position that allows ice from the dispensing tube to fill the serving chamber, and further to an open position that dispenses ice from the serving chamber. The transfer opening has a protruding edge on an interior face thereof, the protruding edge being configured to break up ice within the dispensing tube when the dispensing tray is slid from the fill position to the open position.

19 Claims, 4 Drawing Sheets

ICE DISPENSER

BACKGROUND

Ice buckets and coolers are often used for keeping ice from melting so that it can be used for keeping drinks cold when an ice machine or ice cube dispenser is not readily available. A cooler filled with ice may be useful, but each time ice is removed, a lid of the cooler is opened, allowing for warm air to enter, reducing a useful length of time for the cooler as the ice melts from raised temperatures. Moreover, removal of ice from the cooler presents several challenges. Some users may struggle to pick up a desired serving of ice using tongs or scoops. Other users may be tempted to use their hands to remove ice from the cooler, potentially contaminating the remaining ice in the cooler.

It is with respect to these and other general considerations that embodiments have been described. Also, although relatively specific problems have been discussed, it should be understood that the embodiments should not be limited to solving the specific problems identified in the background.

SUMMARY

Aspects of the present disclosure are directed to an improved ice dispenser.

In embodiments, the improved ice dispenser has a dispensing tray configured to slide between a closed position that keeps ice within the dispensing tray and an open position that dispenses ice from the dispensing tray. The dispensing tray receives ice from a housing having an ice reservoir configured to hold and configured to slidably receive the dispensing tray. The ice dispenser further uses a dispensing tube that is coupled with the housing and has a feed opening that receives ice from the ice reservoir and a transfer opening that feeds ice to the dispensing tray. The dispensing tube comprises a protruding edge on an interior face of the transfer opening, the protruding edge being configured to break up ice within the dispensing tube when the dispensing tray is slid from the closed position to the open position. The ice dispenser also may have an ice agitator that is used to break up or unclog ice that may be blocking the use of the tray or tube.

Other aspects of embodiments of the improved ice dispenser relate to the transfer opening being smaller than the feed opening and where the dispensing tube is contoured to gravity feed the ice to the transfer opening. The dispensing tray may further have a front face that substantially closes the tray opening of the housing when the dispensing tray is in the closed position. An agitator opening is configured to conform to a shaft of the ice agitator to slidably engage the shaft of the ice agitator; and the ice agitator is configured to slide into and out of the agitator opening to break up ice within the dispensing tube adjacent to the transfer opening.

Other aspects relate to the agitator opening being further configured to conform to the shaft of the ice agitator to rotatably and slidably engage the shaft of the ice agitator, and where the ice agitator is configured to slide into and out of the agitator opening and rotate about an axis of the shaft to break up the ice within the dispensing tube adjacent to the transfer opening. In other embodiments, the agitator may simply rotate or slide back and forth.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS/FIGURES

Non-limiting and non-exhaustive examples are described with reference to the following Figures.

DETAILED DESCRIPTION

In the following detailed description, references are made to the accompanying drawings that form a part hereof, and in which are shown by way of illustrations specific embodiments or examples. These aspects may be combined, other aspects may be utilized, and structural changes may be made without departing from the present disclosure. Embodiments may be practiced as methods, systems, or devices. The following detailed description is therefore not to be taken in a limiting sense, and the scope of the present disclosure is defined by the appended claims and their equivalents.

The present disclosure describes various aspects for an ice dispenser that provide an improved dispensing mechanism. The mechanism includes a dispensing tray that slides between a closed and open position. The closed position keeps ice and cold air (cooled by the ice) within the dispensing tray to reduce melting of the ice, while the open position dispenses a serving of ice from the dispensing tray. The dispensing tray may receive ice from a housing having an ice reservoir configured to hold the ice. The housing includes a tray opening configured to slidably receive the dispensing tray, and an agitator opening configured to receive an ice agitator. The ice dispenser also includes a dispensing tube coupled with the housing, the dispensing tube having a feed opening that receives ice from the ice reservoir and a fill opening that feeds ice to the dispensing tray. The dispensing tube includes a protruding edge on an interior face of the fill opening. The protruding edge is configured to break up ice within the dispensing tube when the dispensing tray is slid from the closed position to the open position. The protruding edge and the ice agitator are usable to break up ice in the dispensing tube, reducing the likelihood of clogs and ice bridging. Moreover, the dispensing tray promotes the hygienic removal of a single serving of ice using a simple sliding motion, instead of using tongs or scoops.

Figure 1B:
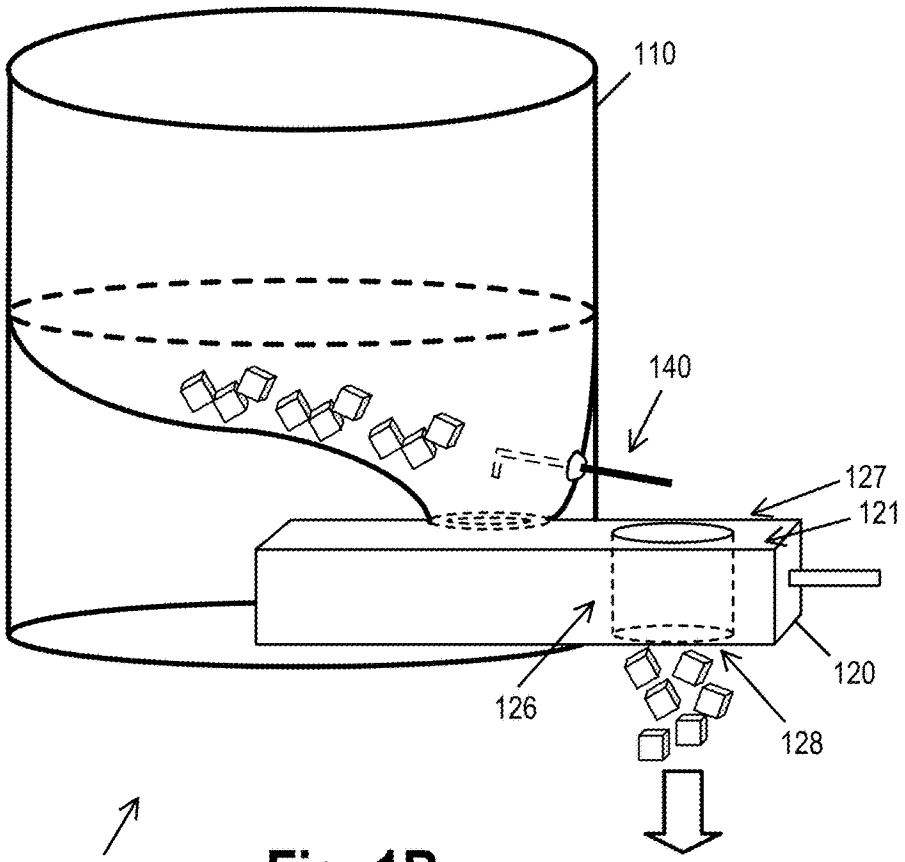
FIG. 1B shows a side perspective view of the ice dispenser of FIG. 1A with the dispensing tray in an open position, according to an example embodiment.
Figure 1A:
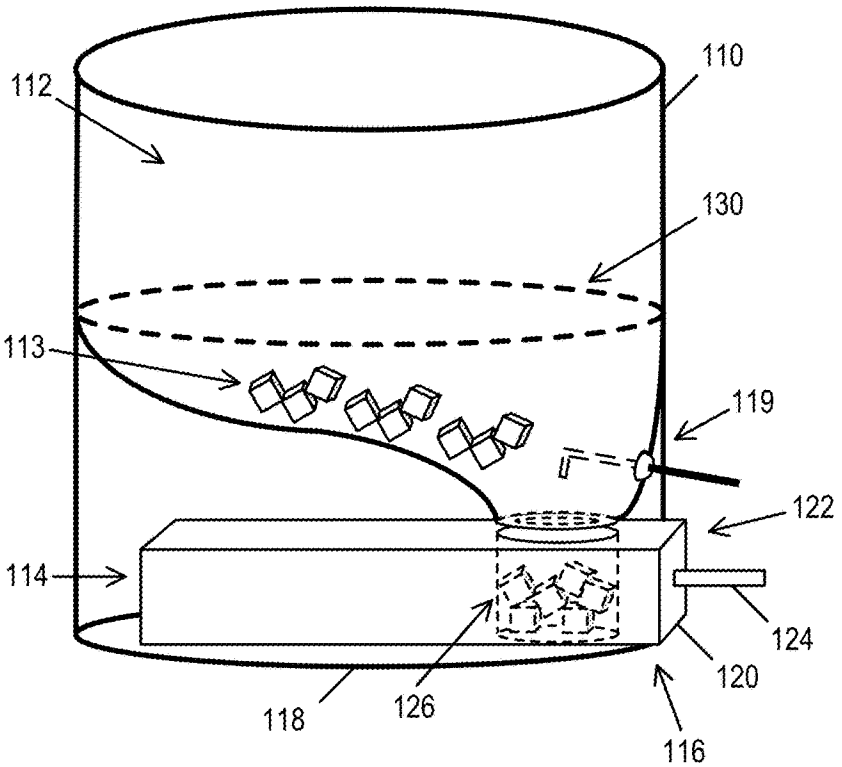
FIG. 1A shows a side perspective view of an example ice dispenser with a dispensing tray in a closed position, according to an example embodiment.
Figure 2:
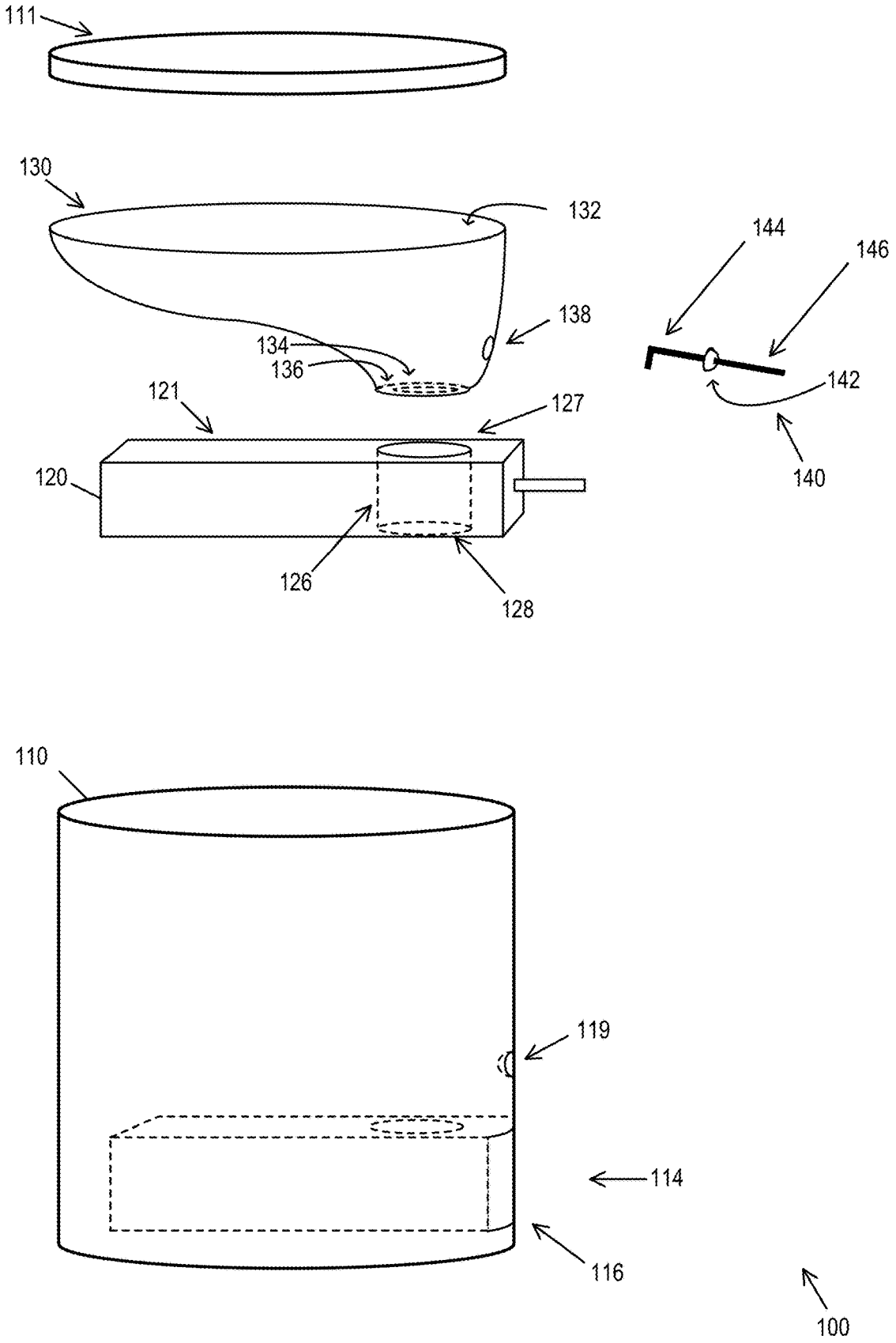
FIG. 2 shows an exploded perspective view of the ice dispenser of FIG. 1A, according to an example embodiment.
Figure 3B:
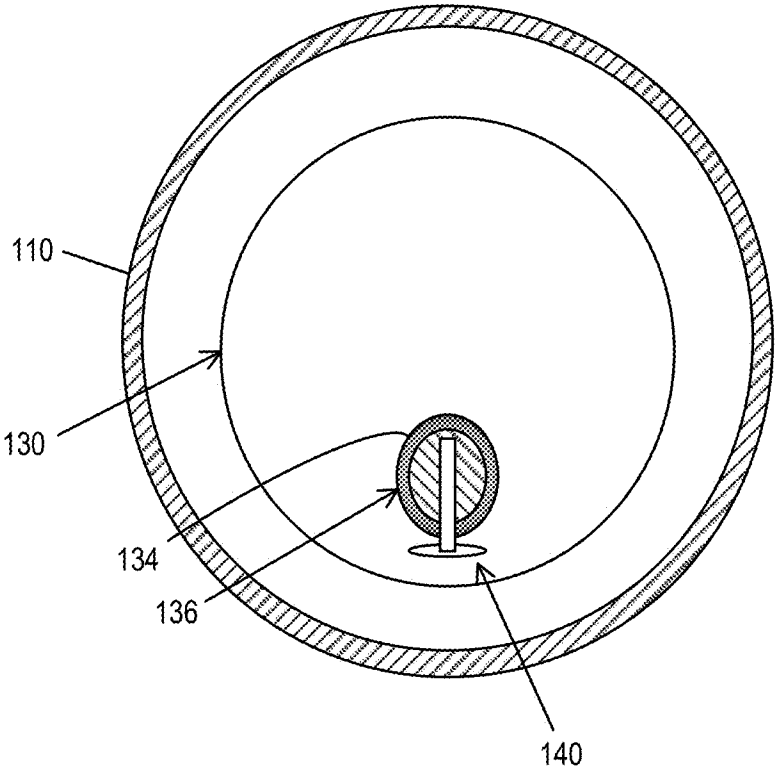
FIG. 3B shows a top perspective view of the ice dispenser of FIG. 3A, according to an example embodiment.
Figure 3A:
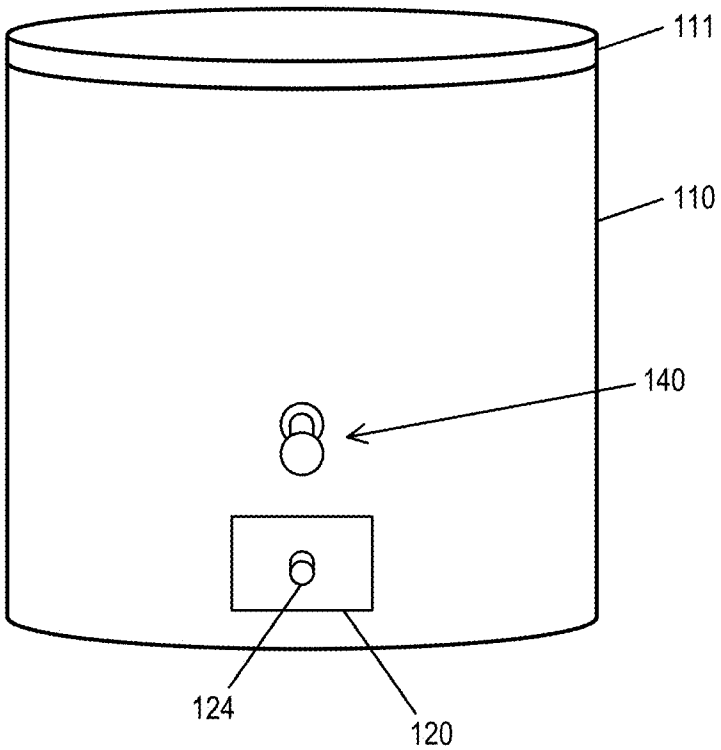
FIG. 3A shows a front perspective view of an ice dispenser, according to an example embodiment.

This and many further embodiments for an ice dispenser are described herein. For instance, FIG. 1A shows a side perspective view of an example ice dispenser 100 with a dispensing tray 120 in a closed position, according to an example embodiment. FIG. 1B shows a side perspective view of the ice dispenser 100 of FIG. 1A with the dispensing tray 120 in an open position, according to an example embodiment. FIG. 2 shows an exploded perspective view of the ice dispenser 100, according to an example embodiment. FIG. 3A shows a front perspective view of an ice dispenser, according to an example embodiment. FIG. 3B shows a top perspective view of the ice dispenser of FIG. 3A with a housing lid 111 removed, according to an example embodiment.

Referring to FIG. 2, the ice dispenser 100 generally comprises a housing 110, a housing lid 111, and the dispensing tray 120. The housing lid 111 is removably attached to the housing 110 using a suitable fastening mechanism, such as latches, complementary mating surfaces (e.g., a threaded interface, a slot and tab interface), a friction fit, screws or other fasteners, etc. The housing lid 111 may be removed by a user to put ice 113 into the housing 110, then secured in place to keep the ice cold.

The housing 110 includes an ice reservoir 112 configured to suitably store the ice 113 and a dispensing tube 130 that is configured to facilitate a transfer of the ice 113 into the dispensing tray 120. The housing 110 is shown in the figures with a cylindrical shape, but other shapes may be used, in other embodiments. In some embodiments, the housing 110, the ice reservoir 112, and the dispensing tube 130 are integrally formed, for example, from a molded composite material or plastic. In other embodiments, the ice reservoir 112 and the dispensing tube 130 are integrally formed and installed into the housing 110. In still other embodiments, each of the housing 110, the ice reservoir 112, and the dispensing tube 130 are formed separately and assembled with a suitable fastening mechanism (e.g., plastic welding, adhesive, fasteners, etc.). The ice reservoir 112 and dispensing tube 130 may be formed from any suitable food-safe material, such as polypropylene, high density polyethylene (HDPE), low density polyethylene (LDPE), polycarbonate, aluminum, stainless steel, etc. In some embodiments, one or more of the housing 110, the ice reservoir 112, and the dispensing tube 130 are formed with a thermal insulation layer, such as Styrofoam, polyethylene foam, polyurethane foam, etc. In some examples, one or more of the housing 110, the ice reservoir 112, and the dispensing tube 130 are formed with interior and exterior walls having a hollow air gap between them to provide thermal insulation. Other forms of a thermal insulation layer, which may be used in other embodiments, will be apparent to those skilled in the art.

The housing 110 has a tray opening 116 that opens into a tray cavity 114, into which the dispensing tray 120 may be slidably inserted. Generally, the tray cavity 114 is located adjacent to a lower surface 118 of the housing 110 to maximize a volume and thus ice storage capacity of the housing 110. In some examples, however, the tray cavity 114 may be located above the lower surface 118, for example, to provide additional space for insulation along the lower surface 118. Although not shown, the lower surface 118 may include legs or a stand configured to keep the lower surface 118 elevated off of a surface on which the ice dispenser 100 is placed to reduce heat transfer from the surface (e.g., from a hot sidewalk).

Generally, the housing 110 and the dispensing tray 120 are configured to provide fluid communication for the ice from the ice reservoir 112, through the dispensing tube 130, and into the dispensing tray 120 when the dispensing tray 120 is located in a closed position (FIG. 1A). The fluid communication for the ice is blocked by an upper surface of the dispensing tray 120 when the dispensing tray 120 is slid towards an open position (FIG. 1B). This configuration reduces ice falling into the tray cavity 114 where it would become unavailable for use and may obstruct the dispensing tray 120 from fully closing.

In some circumstances, ice within the dispensing tube 130 may stick together into clumps, especially near the dispensing tray 120. To break up the clumps of ice, the housing 110 comprises an agitator opening 119 configured to receive an ice agitator 140. The ice agitator 140 may be manipulated by a user to break up pieces of ice within a clump, allowing the ice to fall into the dispensing tray 120, as described below.

The dispensing tube 130 may be formed with a suitable slope from an interior face of the ice reservoir 112 towards the dispensing tray 120 so that ice may be gravity fed from the ice reservoir 112 into the dispensing tray 120. In some examples, the slope includes channels (not shown) for drainage. In some examples, the channels are directed towards the dispensing tray 120. In other examples, the channels are directed away from the dispensing tray 120, for example, towards a drain hole of the housing 110, so that water from melting ice does not collect within the dispensing tray 120. Although not shown, in some examples, a flexible gasket or flap is provided around all or a portion of the transfer opening 134 to ensure that ice does not become lodged between the dispensing tray 120 and the dispensing tube 130.

The ice 113 may be dispensed to a user via the dispensing tray 120, using gravity to feed the ice 113 from the housing 110 into the dispensing tray 120 and then to the user, for example, into a cup or thermos. The dispensing tray 120 has a front face 122 with a handle 124 that the user may pull or push to slide the dispensing tray 120 between the open and closed positions. In some examples, the front face 122 substantially closes the tray opening 116 when the dispensing tray 120 is in the closed position, which improves thermal insulation of the ice dispenser 100.

The dispensing tray 120 has a serving chamber 126 into which ice 113 from the dispensing tube 130 is received. The serving chamber 126 is sized to hold a suitable serving of ice, such as a predetermined volume of 2 fluid ounces, 3 fluid ounces, or other suitable amount. In some examples, the serving chamber 126 is configured to be resizable by the user, for example, by adjusting a position of a rear wall of the serving chamber 126 to be closer to or further from the front face 122, which reduces or increases the predetermined volume, respectively. Adjustment of the predetermined volume may be helpful when changing types of ice that are present within the ice dispenser 100. For example, large cubes of ice (e.g., 1 inch square) may have more air space between cubes within the serving chamber 126 and thus benefit from a larger predetermined volume as compared to small pieces of crushed ice within minimal air space between pieces.

The serving chamber 126 has a fill opening 127, located on an upper surface 121 of the dispensing tray 120 and through which the ice 113 is received from the dispensing tube 130. Ice 113 within the serving chamber 126 may be released out of a dispensing opening 128, located on a lower surface of the dispensing tray 120. In the example shown in figures, the serving chamber 126 is cylindrical in shape and located towards the front face 122 of the dispensing tray 120. In other examples, the serving chamber 126 may be slightly conical in shape (i.e., narrowing towards its bottom), but other shapes will be apparent to those skilled in the art. The serving chamber 126 may also be located at a different position within the dispensing tray 120. In one example, the serving chamber 126 is located closer to an axial center of the housing 110 (e.g., further from an outside environment of the housing 110; FIG. 4) to improve thermal insulation and reduce melting.

The dispensing tube 130 includes a feed opening 132 into which ice is received from the ice reservoir 112 and a transfer opening 134 from which the ice is fed into the dispensing tray 120. In some examples, the transfer opening 134 is smaller than the feed opening 132 and the dispensing tube 130 is contoured to gravity feed the ice to the transfer opening 134. The dispensing tube 130 comprises a protruding edge 136 on an interior face of the transfer opening 134. The protruding edge 136 is configured to break up ice within the dispensing tube 130 when the dispensing tray 120 is slid from the closed position (FIG. 1A) to the open position (FIG. 1B). Generally, the fill opening 127 is located coaxially with the dispensing opening 128. However, in some examples, the fill opening 127 may be offset from the dispensing opening 128 so that the serving chamber 126 has slanted walls that reduce a speed of the ice that is dispensed from the serving chamber 126. In other words, the ice 113 slides down the slanted walls rather than falling straight downwards when dispensing the ice 113.

The dispensing tube 130 also comprises an agitator opening 138 through which the ice agitator 140 extends. Generally, the agitator opening 138 is adjacent to the agitator opening 119 of the housing 110, allowing the ice agitator 140 to pass through from outside of the housing 110 into the dispensing tube 130.

As described above, the ice agitator 140 is configured to break up the clumps of ice within the dispensing tube 130. In the example shown in FIG. 2, the ice agitator 140 comprises a ball 142 as well as a shaft 144 extending through the ball 142 and having a handle 146. The shaft 144 may include a bend, protrusion, ridge, or other feature that improves breakup of the ice when manipulating the ice agitator 140.

The agitator opening 119 and the agitator opening 138 are configured to receive the ball 142 to form a ball and socket joint. By manipulating the handle 146, the user may rotate the shaft 144 about the ball 142, causing the opposing end of the ice agitator 140 to move within the dispensing tube 130 and break up the clumps of ice. In some examples, the shaft 144 is fixed within the ball 142 so that the shaft 144 is only able to pivot about the ball 142. In other examples, the shaft 144 is configured to slide within the ball 142 so that the shaft 144 may pivot about the ball 142 and also slide in and out of the ball 142, to provide increased movement of the shaft 144 within the dispensing tube 130.

In other examples, the ball 142 of the ice agitator 140 is omitted. For example, the agitator opening 119 and the agitator opening 138 are configured to slidably receive the ice agitator 140. Sliding the ice agitator 140 causes the opposing end of the ice agitator 140 to move within the dispensing tube 130 and break up the clumps of ice. In some examples, the ice agitator 140 is configured to slide towards the protruding edge 136 of the transfer opening 134 to break up ice at the transfer opening 134 and reduce a likelihood of ice clumps that jam the dispensing tray 120 from sliding in and/or out of the tray cavity 114.

Figure 4A:
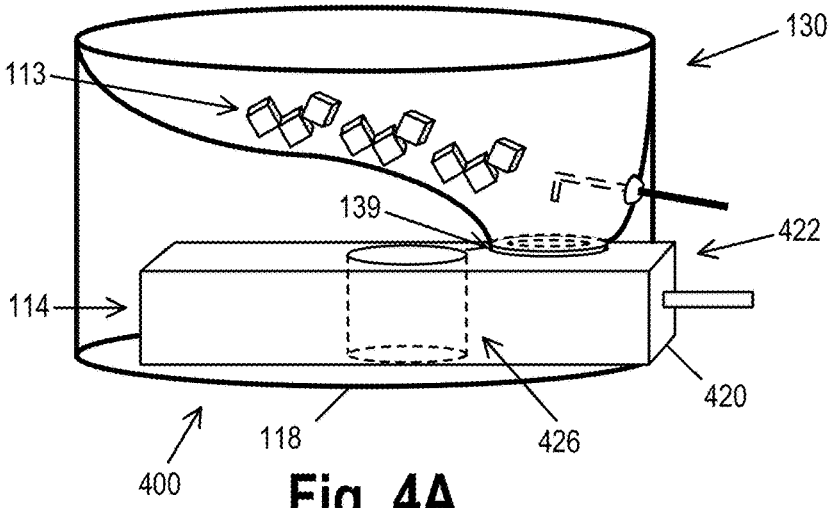
FIG. 4A shows a side perspective view of another example of a dispensing tray in a closed position, according to an example embodiment.
Figure 4B:
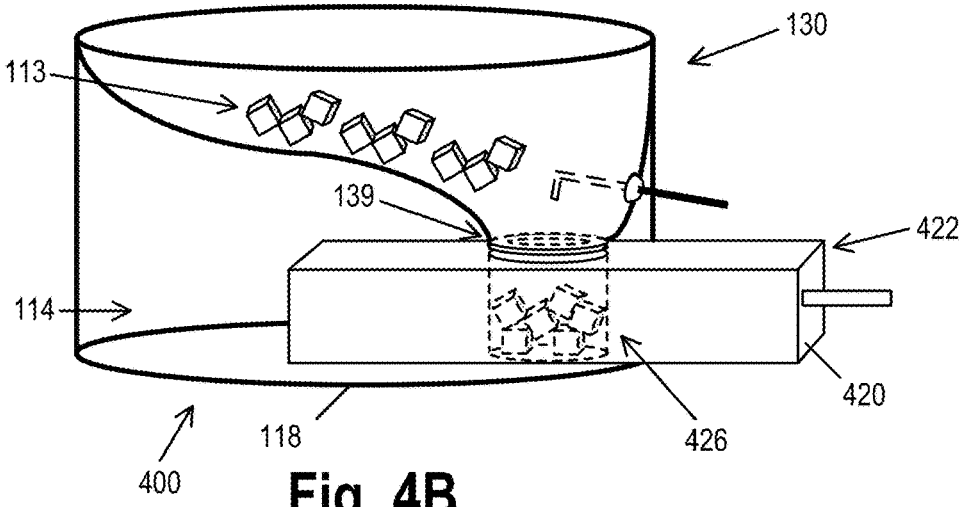
FIG. 4B shows a side perspective view of the dispensing tray of FIG. 4A in a fill position, according to an example embodiment.
Figure 4C:
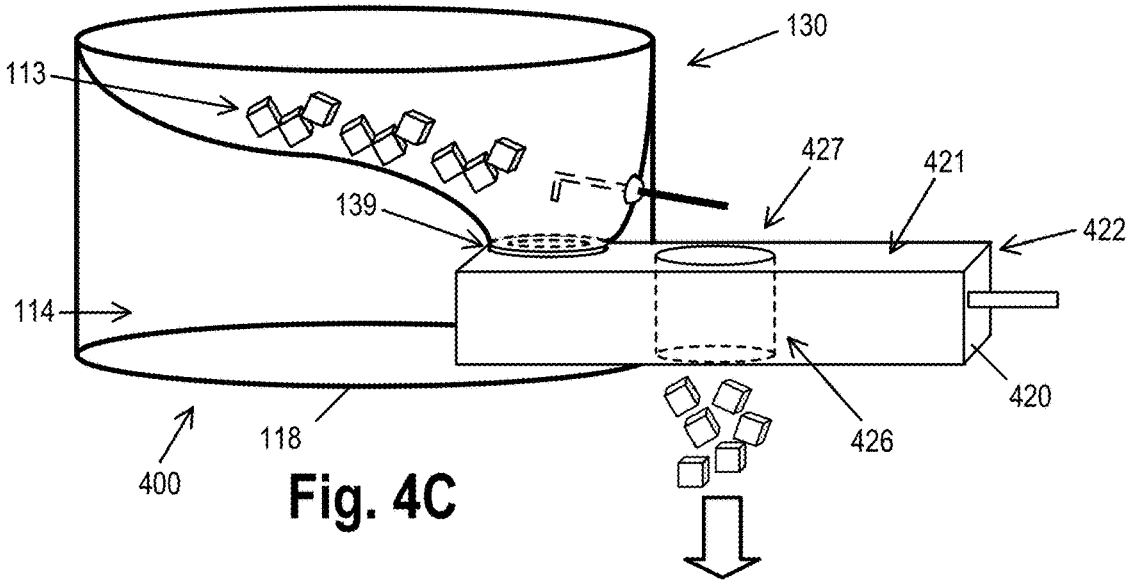
FIG. 4C shows a side perspective view of the dispensing tray of FIG. 4A in an open position, according to an example embodiment.

FIG. 4A shows a side perspective view of another example of a dispensing tray 420 in a closed position, according to an example embodiment. FIG. 4B shows a side perspective view of the dispensing tray of FIG. 4A in a fill position, according to an example embodiment. FIG. 4C shows a side perspective view of the dispensing tray of FIG. 4A in an open position, according to an example embodiment. The dispensing tray 420 generally corresponds to the dispensing tray 120, but has a serving chamber 426 that is located further from a front face 422 of the dispensing tray 420. In this example, the serving chamber 426 is located at an axial center of the housing 110 (e.g., further from an outside environment of the housing 110) to improve thermal insulation around the serving chamber 426, reducing melting of the ice within the serving chamber.

The serving chamber 426 has a fill opening 427, located on an upper surface 421 of the dispensing tray 120 and through which the ice 113 is received from the dispensing tube 130. In some embodiments, the dispensing tube 130 may have better thermal insulation than the dispensing tray 120 so that melting may be reduced by keeping the ice in the dispensing tube 130 until the ice is dispensed. In the example shown in FIGS. 4A, 4B, and 4C, ice 113 is generally held within the dispensing tube 130 by the upper surface 421 when the dispensing tray 420 is located in the closed position. When the dispensing tray 420 is moved to the fill position (FIG. 4B), ice is dispensed from the dispensing tube 130 into the serving chamber 426 through the fill opening 427. When the dispensing tray 420 is moved to the open position (FIG. 4C), ice is dispensed from the serving chamber 426 to the user. In the open position, the upper surface 421 prevents additional ice from falling into the tray cavity 114. In some examples, the dispensing tube 130 further comprises a flexible or semi-flexible gasket 139 around all or a portion of the transfer opening 134 that provides an improved seal between the upper surface 421 and the transfer opening 134 of the dispensing tube 130.

The description and illustration of one or more aspects provided in this application are not intended to limit or restrict the scope of the disclosure as claimed in any way. The aspects, examples, and details provided in this application are considered sufficient to convey possession and enable others to make and use the best mode of claimed disclosure. The claimed disclosure should not be construed as being limited to any aspect, example, or detail provided in this application. Regardless of whether shown and described in combination or separately, the various features (both structural and methodological) are intended to be selectively included or omitted to produce an embodiment with a particular set of features. Having been provided with the description and illustration of the present application, one skilled in the art may envision variations, modifications, and alternate aspects falling within the spirit of the broader aspects of the general inventive concept embodied in this application that do not depart from the broader scope of the claimed disclosure.

The use of any and all examples, or exemplary language (e.g., "such as") provided herein, is intended merely to better illuminate the disclosed embodiments and does not pose a limitation on the scope of the disclosed embodiments unless otherwise claimed. Numerous modifications and adaptations will be readily apparent to those of ordinary skill in this art.

What is claimed is:

1. An ice dispenser, comprising:

a dispensing tray configured to slide between a closed position that keeps ice within the dispensing tray and an open position that dispenses the ice from the dispensing tray;

an ice agitator;

a housing having an ice reservoir configured to hold the ice, the housing having a tray opening configured to slidably receive the dispensing tray, and an agitator opening configured to receive the ice agitator;

a dispensing tube coupled with the housing, the dispensing tube having a feed opening that receives ice from the ice reservoir and a transfer opening that feeds the ice to the dispensing tray; and wherein the dispensing tube comprises a protruding edge on an interior face of the transfer opening, the protruding edge being configured to break up the ice within the dispensing tube when the dispensing tray is slid from the closed position to the open position.

2. The ice dispenser of claim 1, wherein the transfer opening is smaller than the feed opening and the dispensing tube is contoured to gravity feed the ice to the transfer opening.

3. The ice dispenser of claim 1, wherein the dispensing tray has a front face that closes the tray opening of the housing when the dispensing tray is in the closed position.

4. The ice dispenser of claim 1, wherein:

the agitator opening is configured to conform to a shaft of the ice agitator to slidably engage the shaft of the ice agitator; and the ice agitator is configured to slide into and out of the agitator opening to break up the ice within the dispensing tube adjacent to the transfer opening.

5. The ice dispenser of claim 4, wherein:

the agitator opening is further configured to conform to the shaft of the ice agitator to rotatably and slidably engage the shaft of the ice agitator; and the ice agitator is configured to slide into and out of the agitator opening and rotate about an axis of the shaft to break up the ice within the dispensing tube adjacent to the transfer opening.

6. The ice dispenser of claim 1, wherein:

the agitator opening is configured to conform to a shaft of the ice agitator to rotatably engage the shaft of the ice agitator; and the ice agitator is configured rotate about an axis of the shaft to break up the ice within the dispensing tube adjacent to the transfer opening.

7. The ice dispenser of claim 1, wherein:

the agitator opening has a socket that receives a ball of the ice agitator to form a ball and socket joint; and the ice agitator has a shaft that extends from the ball into the dispensing tube and breaks up the ice within the dispensing tube when the ice agitator is rotated about the ball and socket joint.

8. The ice dispenser of claim 7, wherein the shaft extends through and is slidable into and out of the ball to break up the ice within the dispensing tube.

9. The ice dispenser of claim 1, wherein:

the dispensing tray comprises a serving chamber having a fill opening on an upper surface of the dispensing tray and a dispensing opening on a lower surface of the dispensing tray; and the fill opening of the serving chamber is configured to receive the ice from the transfer opening of the dispensing tube and the dispensing opening is configured to dispense the ice from the serving chamber through the dispensing opening.

10. The ice dispenser of claim 9, wherein the serving chamber is configured to receive the ice from the transfer opening of the dispensing tube and gravity feed the ice through the dispensing opening.

11. The ice dispenser of claim 10, wherein the fill opening of the serving chamber is aligned with the transfer opening of the dispensing tube when the dispensing tray is in the closed position.

12. The ice dispenser of claim 11, wherein:

the tray opening opens into a tray cavity of the housing configured to receive the dispensing tray; and the tray cavity comprises a lower surface that prevents the ice from leaving the serving chamber while the dispensing tray is in the closed position.

13. The ice dispenser of claim 9, wherein the upper surface of the dispensing tray covers the transfer opening of the dispensing tube when the dispensing tray is between the closed position and the open position.

14. The ice dispenser of claim 13, wherein:

the tray opening opens into a tray cavity of the housing configured to receive the dispensing tray; and the tray cavity comprises a lower surface that prevents the ice from leaving the serving chamber while the dispensing tray is in the closed position and until the dispensing tray reaches the open position.

15. An ice dispenser, comprising:

a dispensing tray having a serving chamber configured to hold a serving of ice, the serving chamber having a fill opening on an upper surface of the dispensing tray and a dispensing opening on a lower surface of the dispensing tray;

a housing having a dispensing tube with a transfer opening configured to dispense the ice to the serving chamber through the fill opening of the serving chamber;

wherein the housing further comprises a tray opening configured to slidably receive the dispensing tray;

wherein the dispensing tray is configured to slide from a closed position that keeps the ice within the dispensing tube, to a fill position that allows the ice from the dispensing tube to fill the serving chamber, and further to an open position that dispenses the ice from the serving chamber; and wherein the transfer opening has a protruding edge on an interior face thereof, the protruding edge being configured to break up the ice within the dispensing tube when the dispensing tray is slid from the fill position to the open position.

16. The ice dispenser of claim 15, further comprising an ice agitator; and wherein the housing further comprises an ice reservoir configured to hold the ice and an agitator opening configured to receive the ice agitator.

17. The ice dispenser of claim 16, wherein the dispensing tube is contoured to gravity feed the ice from the ice reservoir to the fill opening of the serving chamber.

18. The ice dispenser of claim 17, wherein:

the agitator opening is configured to conform to a shaft of the ice agitator to slidably engage the shaft of the ice agitator; and the ice agitator is configured to slide into and out of the agitator opening to break up the ice within the ice reservoir adjacent to the transfer opening of the dispensing tube.

19. The ice dispenser of claim 18, wherein:

the dispensing tube further comprises a gasket around all or a portion of the transfer opening of the dispensing tube; and the gasket is configured to provide a seal between the upper surface of the dispensing tray and the transfer opening of the dispensing tube.

* * * * *